United States Patent [19]

Keller

[11] Patent Number: 5,022,322

[45] Date of Patent: Jun. 11, 1991

[54] METERING ROLLER CONTROL APPARATUS

[76] Inventor: James J. Keller, 4023 Glenridge Road, Dallas, Tex. 75220

[21] Appl. No.: 510,727

[22] Filed: Apr. 18, 1990

[51] Int. Cl.[5] ..... B41F 7/40

[52] U.S. Cl. ..... 101/148; 118/259; 101/350

[58] Field of Search ..... 101/148, 350, 351, 352, 101/349; 118/258, 259, 262

[56] References Cited

U.S. PATENT DOCUMENTS

| | | | |
|---|---|---|---|
| 3,647,525 | 3/1972 | Dahlgren | 101/148 X |
| 4,428,291 | 1/1984 | Dorow | 101/350 |
| 4,524,690 | 6/1985 | Omori | 101/148 |
| 4,671,175 | 6/1987 | Zimmer et al. | 101/148 |
| 4,741,269 | 5/1988 | Aylor et al. | 101/148 |
| 4,848,228 | 7/1989 | Svoboda et al. | 101/148 X |
| 4,949,637 | 8/1990 | Keller | 101/148 |

*Primary Examiner*—Clifford D. Crowder
*Attorney, Agent, or Firm*—Ross, Howison, Clapp & Korn

[57] ABSTRACT

A metering roller engages a liquid pickup roller to meter liquid through the nip therebetween. A stationary shaft through the middle of the metering roller carries spaced bearings at adjustable locations engaging the inside of the roller. A fulcrum is provided to support the stationary shaft near each end thereof. A forcing cam spaced inwardly from each fulcrum has an adjustable pivot point, and is forced into engagement with the stationary shaft to produce bending moments in the shaft transmitted to the roller through the bearings to bias the metering roller toward the metering nip. The position of each fulcrum may be adjusted in two directions, and the magnitude of the bending moments adjusted by moving the forcing cam pivot point.

17 Claims, 3 Drawing Sheets

METERING ROLLER CONTROL APPARATUS

TECHNICAL FIELD OF THE INVENTION

This invention relates to apparatus to control the metering of a liquid through the nip between a liquid pickup roller and a metering roller cooperating therewith. The invention is particularly adapted for use in dampeners and the like for printing presses.

BACKGROUND OF THE INVENTION

The use of a metering roller having an adjustable engagement with a liquid carrying roller for metering the liquid through the nip between the two rollers is well known in the art. One application for such an apparatus is found in dampeners utilized with offset presses.

In one commercial form of dampener, a liquid pickup roller is rotated in a pan of water and is engaged with a metering roller having variable pressure engagement therewith for permitting control of the amount of liquid delivered through the nip between the two rollers. The liquid received by the metering roller is transferred to a form roller, either directly or through an intermediate roller. An oscillating roller which moves back and forth in the direction of the roller axis typically engages the form roller for a final evening of the liquid carried by the form roller. The dampener is mounted on top of an offset press so that the liquid metered to the form roller is then transferred to the plate cylinder of the press.

The amount of liquid delivery is controlled by the nip between the pickup roller and the metering roller. One arrangement for providing this control is simply to utilize a stationary, non-rotating shaft positioned through the center of the metering roller, and having bearings positioned at each end of the metering roller engaging the roller and the stationary shaft. By providing adjustment screws bearing on the stationary shaft near its ends, the metering roller may be urged to a greater or lesser extent toward the pickup roller. By increasing the force exerted by the adjustment screws, more pressure is provided to the nip, reducing liquid transfer through the nip.

While this arrangement works quite satisfactorily with relatively narrow presses, it is insufficient to provide adequate control when the length of the metering roller is more than about twenty inches. With increasing width, less control is exerted over the central section of the metering nip.

One possible solution which has been utilized in commercial machines having greater roller widths is to provide a slight crown on the pickup roller so that its widest diameter is at the center of the roller and the roller tapers slightly toward both ends. While this arrangement does increase the ability to exert pressure at the nip in the center of the roller, it provides a relatively inflexible arrangement which does not permit the operator the flexibility of carefully controlled adjustments of the metering roller. This can be a problem, particularly if the press operates with a range of different printing patterns and speeds.

As a result, one line of commercial presses has employed a "skew system" which permits adjustment of the angle between the axis of the pickup roller and the axis of the metering roller. By adjustment of the axis of one of the rollers from a parallel orientation with the other, less pressure can be exerted at the edges of the nip vis-a-vis the center of the nip. While this skew system does give improved control, it is a relatively expensive and complicated arrangement, and one which is not simple to use.

In accordance with the present invention, there is provided an improved control apparatus for a metering roller. Apparatus may be constructed in accordance with the invention which is relatively inexpensive, and by which control can be implemented with very simple and straightforward adjustments. The invention is applicable to dampener systems for presses, and may also be applied in other liquid metering situations. For example, it is contemplated that this control apparatus will be useful in metering liquid coatings to be applied to paper at the conclusion of a printing process.

SUMMARY OF THE INVENTION

In accordance with the invention, apparatus is provided for controlling the metering of a liquid which employs a stationary shaft, a metering roller surrounding the stationary shaft and a fluid pickup roller engaging the metering roller, whereby liquid is metered through the nip between the two rollers as they rotate together. The system includes fulcrum and force application means associated with each end of the stationary shaft for producing bending moments biasing the central portion of the stationary shaft in a direction generally toward the fluid pickup roller. At least one bearing engages the stationary shaft adjacent the interior of the metering roller and engages the rotatable inwardly facing surface of the metering roller. Adjustment means are provided for selectively adjusting the bending moments produced by the fulcrum and force application means. Preferably, the bearing system includes a plurality of annular bearings axially spaced along the stationary shaft to engage the metering roller, distributing along the roller forces resulting from the bending moments produced in the stationary shaft. Preferably the bearings are releasably secured in their position on the shaft so that their axial locations may be adjusted. The preferred orientation of the bearings is in locations spaced inwardly from the ends of the metering roller, arranged symmetrically with respect to the midpoint between the ends of the metering roller.

In a particular form of the invention, the fulcrum and the force application means includes a first and second fulcrum receiving the stationary shaft adjacent its first and second ends, and supporting the shaft in at least a first direction perpendicular to the shaft. First and second force applying means engage the stationary shaft at a location spaced inwardly along the shaft from the first and second fulcrums, respectively, and exert an adjustable force on the stationary shaft in a second direction substantially opposite to the first direction. In a preferred form of the invention, each fulcrum comprises first and second screws oriented at an acute angle with ends adjacent to receive and support the stationary shaft therebetween, and each screw is adjustable to change the support point for the stationary shaft in the direction of the screw axis.

In one form of the invention, each fulcrum is carried by one of a pair of side frames near each end of the stationary shaft, and each force applying means is mounted on a mounting block positioned on the interior face of the side frame and pivotable about a first pivot point. A forcing cam is mounted on each mounting block and is rotatable with respect thereto about a second pivot point spaced from the first pivot point. The forcing cam has a constant radius outer surface about a major portion of its periphery, and a cutaway surface over a minor portion of the periphery. When the cam is rotated so that its cutaway surface is adjacent the stationary shaft, the cam does not engage the stationary shaft, and when it is rotated so that its curved surface is adjacent the stationary shaft the cam does engage the shaft and create the bending moments. In this embodiment, the adjustment means associated with each force applying means permits adjustment of the pivotal orientation of the mounting block so as to move the second pivot point toward or away from the stationary shaft.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE DRAWINGS

Figure 1:
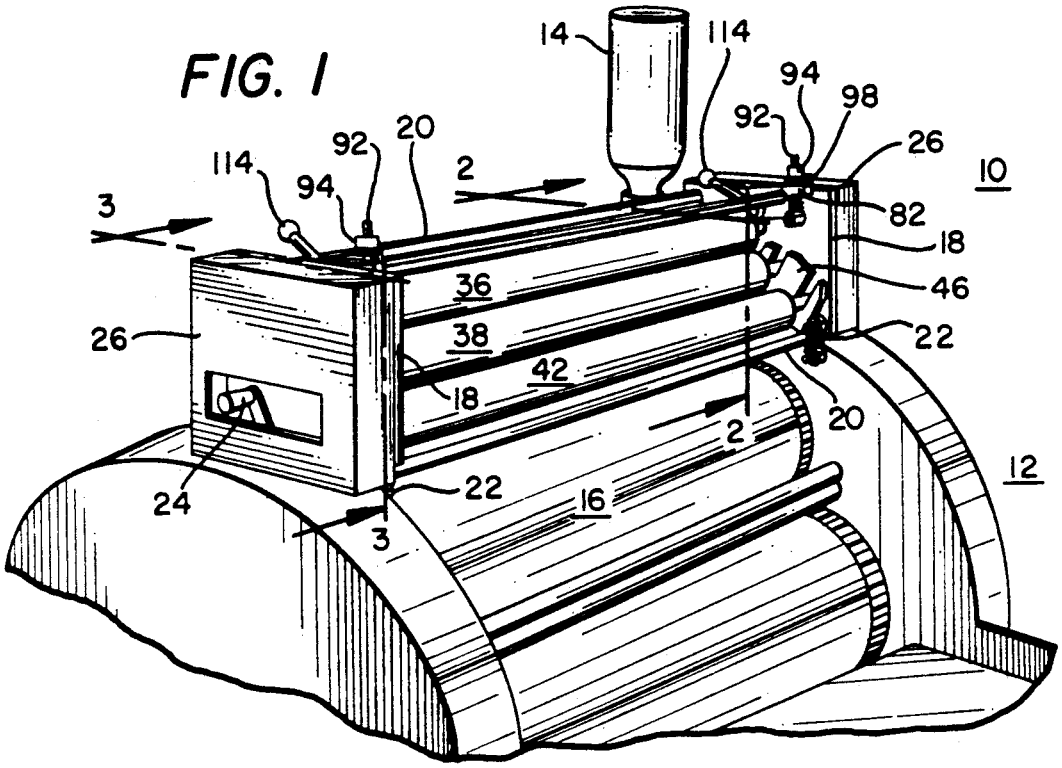
FIG. 1 is a perspective view of an offset press dampener constructed in accordance with the invention.

A press dampener 10 constructed to incorporate the metering roller control apparatus of this invention is shown mounted atop a conventional offset press 12 in FIG. 1. Dampener 10, like conventional dampeners used in the industry, is provided to deliver a controlled small quantity of fluid from reservoir 14 to the plate cylinder 16 of the press 12 during operation. The framework for dampener 10 is provided by spaced side plates 18 connected by a plurality of connecting rods 20, two of which may be seen in FIG. 1. The dampener is held in operating engagement with plate cylinder 16 of press 12 by the biasing force of a pair of springs 22. Because side plates 18 are substantially mirror images, and the components of the dampener secured to each are essentially mirror images, a single reference numeral will be applied to each component element secured to side plates 18. As is conventional, the dampener may be propped up from operating engagement with plate cylinder 16 by means of release levers 24, which overcome the biasing force of springs 22 to pivot dampener 10 about its pivotal connection 25 to press 12 in order to disengage the dampener 10 from plate cylinder 18.

Figure 2:
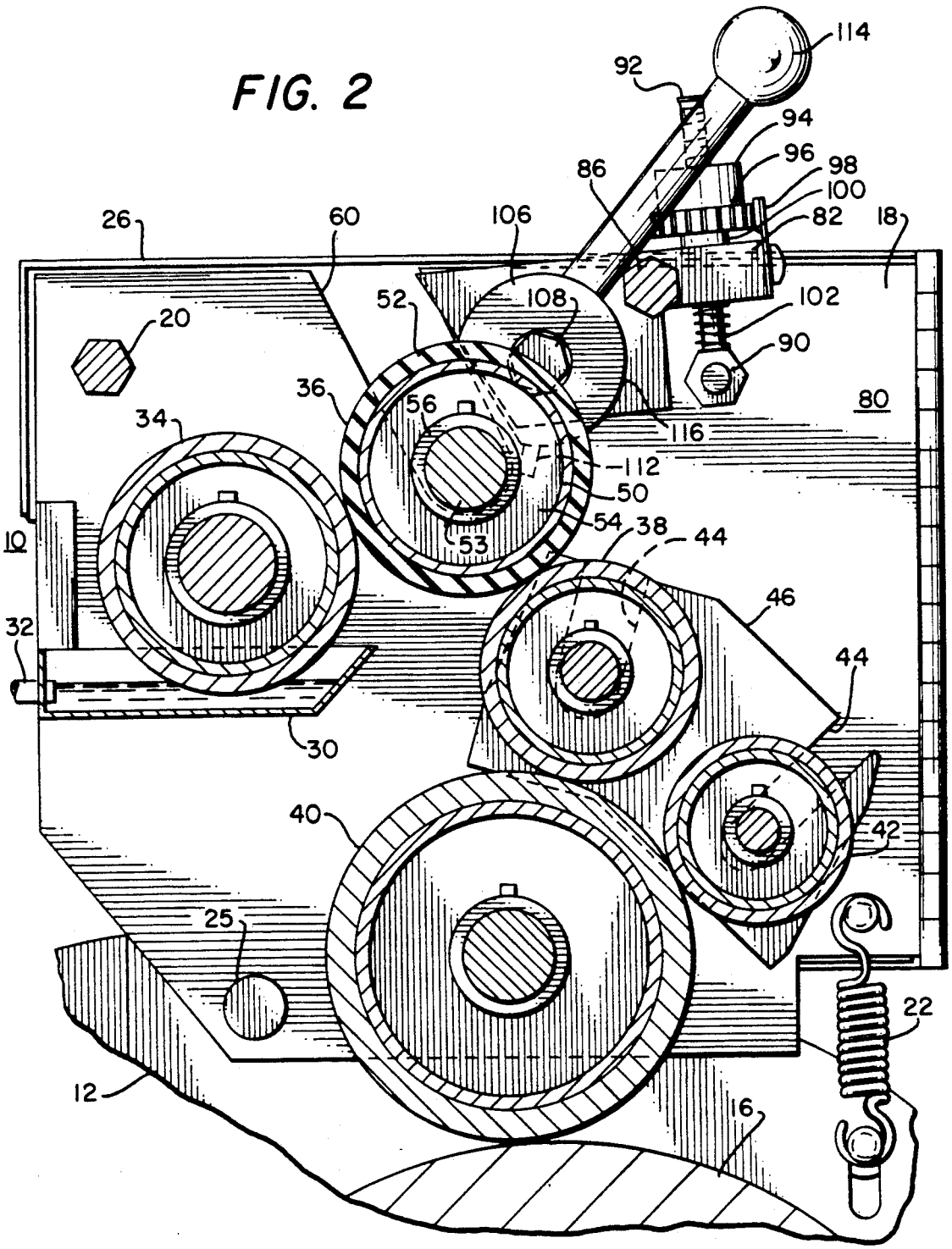
FIG. 2 is a cross sectional view taken along lines 2—2 of FIG. 1 except that the metering control is disengaged.
Figure 4:
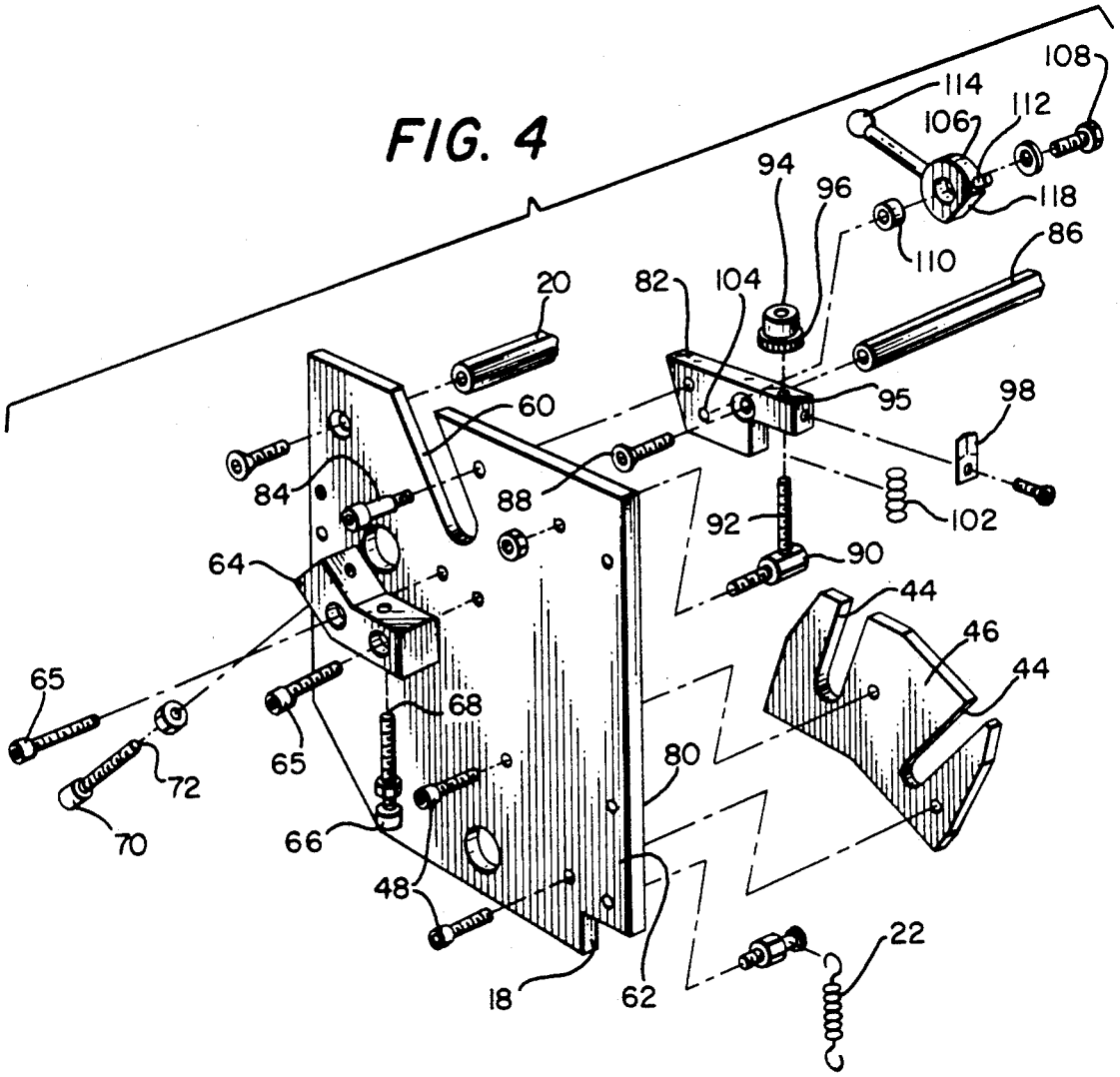
FIG. 4 is an exploded perspective view, with parts broken away for easy reference, of the side frame at one end of the metering roller.

Each of side plates 18 is provided with a hinged door 26 for covering the components mounted on the outsides of plate 18 during operation, but giving access to the same when required. As best seen in FIG. 2, the dampener depicted in these drawings employs a conventional five roller train for delivering fluid to the press 12. Water is maintained in a pan 30 by supply hose 32 from reservoir 14. Water pick-up roller 34 is partially disposed in pan 30. Metering roller 36 engages and cooperates with water pick-up roller 34 to provide a metering nip therebetween. Water metered onto metering roller 36 is transferred by an intermediate roller 38 to form roller 40. As in conventional dampeners, an oscillating roller 42 engages form roller 40 by moving back and forth axially to smooth the liquid distribution prior to transfer to plate cylinder 16. As in conventional dampeners, liquid pick-up roller 34 and form roller 40 are driven by gearing (not shown) from the drive gear of the plate cylinder 16, so that operation of the press provides positive rotation of rollers 34 and 40. The other rollers in the five roller array of the dampener 10 are rotated simply by their frictional engagement with the positively driven rollers 34 or 40. Although the invention has been depicted in connection with a typical five roller dampener, it may also be applied to other combinations of rollers, as long as metering is effected by the controlled engagement of metering roller 36 with liquid pick-up roller 34 to control the liquid delivery through nip to roller 36. For example, intermediate roller 38 is required in this arrangement because of the particular orientation of the water pick-up roller 34 with respect to plate cylinder 16, whereby roller 34 and plate cylinder 16 rotate in the same direction. Where the water pick-up roller and plate cylinder rotate in opposite directions, a conventional four roller arrangement excluding the intermediate roller 38 may be employed.

Figure 5:
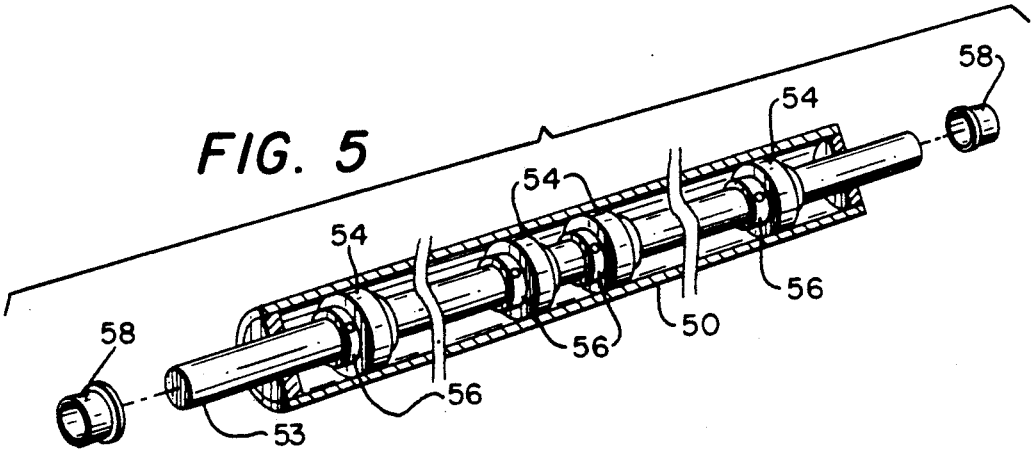
FIG. 5 is a cutaway perspective of the metering roller, stationary shaft and bearings of the apparatus shown in FIGS. 1–4.

In the device depicted, intermediate roller 38 and oscillating roller 42 are mounted for engagement with form roller 40 in slots 44 on journaling plate 46 mounted on the inside of each side frame 18 by means of threaded fasteners 48. Metering roller 36 like the other rollers in dampener 10, is typically formed with a roller core 50 covered by a resilient rubber cover 52. As best seen in FIG. 5, metering roller 36 is provided with a central stationary shaft 53 extending along its axis, within core 50. Stationary shaft 53, which does not rotate as the frictional engagement of rubber cover 52 with water pick-up roller 34 causes metering roller 36 to rotate, is interconnected with core 50 by a series of ball bearings 54 spaced along the axis of stationary shaft 53. Unlike the relationship between a conventional metering roller and its central stationary shaft which are connected by bearings at the ends of the metering roller, bearings 54 are spaced from the ends of roller 36 in order to transmit controlled bending moments to the roller core 50 as will be discussed below. Each bearing 54 is supplied with a mounting collar 56 having a set screw, so that the axial location of each bearing 54 on stationary shaft 52 may be adjusted. The ends of stationary shaft 52 are provided with bearing sleeves 58 for cooperation with the force application mechanism associated with side plates 18 as described below. Metering roller 36 is mounted by sliding stationary shaft 53 into slots 60 extending at an angle from the top of each side plate 18. Each of the slots 60 is wider than stationary shaft 53, so that shaft 53 is not held from movement by slots 60.

Figure 3:
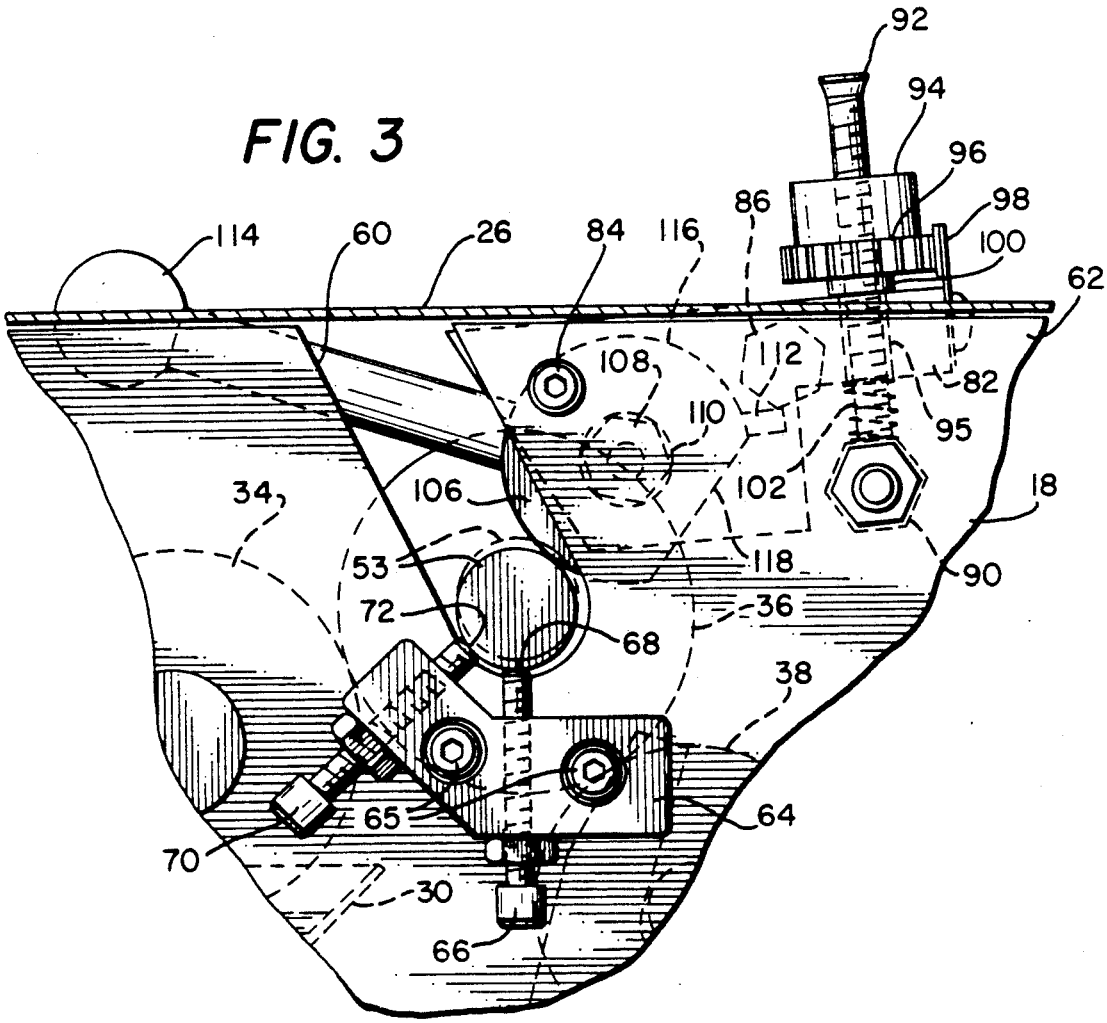
FIG. 3 is a cross sectional view taken along lines 3—3 of FIG. 1, partially broken away, with the metering control engaged.

Each side plate 18 has mounted on its outside face 62 a fulcrum mounting block 64 secured by screws 65. A machine screw 66 extends vertically through block 64 so that its upper threaded end 68 is adjacent the lower portion of slot 60. A second machine screw 70 extends through block 64 at an acute angle to the axis of machine screw 66, so that its threaded end 72 is positioned adjacent end 68 of machine screw 66. The screw ends 68 and 72 thus provide a fulcrum for receiving and supporting the shaft 53. Screws 66 and 70 may protrude to a greater or lesser extent through block 64, so that the position of each end 68 or 72 may be varied. In a typical configuration as depicted in FIG. 3, screws 66 and 70 are adjusted so that, when metering roller 36 is installed, and is resting on rollers 34 and 38 without other force applied, the stationary shaft 53 has clearance from screw ends 68 and 72, as suggested by the phantom line depiction of shaft 53 in FIG. 3.

Means for applying force to stationary shaft 53 near each end thereof are spaced inwardly from each set of fulcrum screws 66 and 70 on the inwardly facing surface 80 of each side plate 18. Mounting block 82 is pivotally mounted on the inside face 80 of each side plate 18 by pivot pin 84. The mounting blocks 82 are interconnected by reinforcing rod 86 extending across the width of the dampener and secured at each end to a mounting block 82 by threaded fastener 88. Mounted below mounting block 82 on the inwardly facing surface 80 of each side plate 18 is a fixed support member 90 from which a vertical threaded shaft 92 extends upwardly. Threaded shaft 92 extends loosely through an opening 95 in mounting block 82. The upper end of shaft 92 has an adjustment nut 94 threaded thereon. Adjustment nut 94 includes a notched detent wheel 96 which cooperates with detent plate 98 carried by mounting block 82 to provide a series of detent positions providing audible "clicks" as the adjustment nut 94 is turned. The lower end of nut 94 includes a boss 100 which is larger than the opening 95 through mounting block 82, so that, as nut 94 is threaded down upon shaft 92, boss 100 exerts downward force on the top of mounting block 82. Spring 102 is positioned around shaft 92 between support member 90 and mounting block 82, to exert a countering biasing force upwardly on mounting block 82. Thus, each mounting block 82, while pivotal around pivot pin 84, is supported in a particular alignment by spring 102. Downward adjustment of nut 94 can be carried out to force the end of block 82 remote from pivot pin 84 downwardly compressing spring 102.

Spaced from pivot pin 84 is threaded aperture 104 in block 90 for mounting the force application mechanism spaced inwardly from each end of stationary shaft 53. A clamping cam 106 is pivotally mounted adjacent aperture 104 by means of threaded fastener 108 secured in aperture 104 through bearing sleeve 110. A rotation stop in the form of set screw 112 extends from one side of clamping cam 106. A clamping lever 114 is carried by cam 106 to pivot the cam 106 on bearing sleeve 110. Each lever 114 may be operated to rotate its cam 106 between an engaged position (as seen in FIG. 3) in which set screw 112 abuts reinforcing rod 86 to stop rotation, and an unengaged position (as seen in FIG. 2) wherein lever 114 rests upon the reinforcing rod 86. Cam 106 has a generally cylindrical surface 116, but over a portion of its periphery, it is cut away so as to present a flat surface 118. In the engaged position of cam 106 depicted in FIG. 3, the cylindrical surface 116 engages bearing sleeve 58 of stationary shaft 53 inwardly from fulcrum screws 66 and 70, and presses the shaft downwardly so that its ends engage the ends of those screws 68 and 72 as depicted in the full line representation of shaft 53 in FIG. 3. Depending upon the adjustment effected by adjustment nut 94 to pivot mounting block 82 and thus aperture 104 about whose axis cam 106 rotates, the pressure of cylindrical surface 116 on stationary shaft 53 may also introduce a selected bending moment to the stationary shaft 53. Bending moments produced by the cams 106 near each end of stationary shaft 52 are transmitted to the roller 36 the spaced bearings 54, to bias roller 36 toward pickup roller 34, increasing the pressure on nip 38.

Adjust of the control apparatus are made with the clamping cams 106 disengaged from bearing sleeves 58. In this unclamped state, it is possible to turn either or both screws 66 and 70 at each side to adjust the fulcrum positions for receiving and supporting shaft 53. Moving the end of one of the screws 66 adjusts the vertical height of the support fulcrum. This adjustment primarily sets the pressure of engagement of rollers 36 and 38, ordinarily desired to be at a minimum level. Turning of screws 70 to change the position of fulcrum ends 72 provides adjustment of the bending point for the bending moments to be produced toward nip 38. Adjustment of each nut 94 increases or lessens the bending moments toward nip 38 by increasing or lessening the interference of cam surface 116 with sleeve 58.

These operational adjustments may be quickly performed by the operator to achieve desired metering of liquid through nip 38. In addition, although not ordinarily needed during operation, repositioning of bearings 54 axially along shaft 53 can be carried out by disassembling the roller 36, to produce a desired profile of force along the length of roller 36.

It will be realized from the foregoing that the invention contemplates an uncomplicated and easy to use mechanism for metering controls. The apparatus enables careful control over the metering operation.

Although the preferred embodiment has been described in detail, it should be understood that various changes, substitutions and alterations can be made therein without department from the spirit and scope of the invention as defined by the appended claims.

I claim:

1. In a liquid metering apparatus having a stationary shaft, a metering roller surrounding the stationary shaft and a liquid pick-up roller engaging the metering roller, whereby liquid is metered through the nip between the two rollers as they rotate together, a system for controlling the metering of liquid comprising:

(a) fulcrum and force application means associated with each end of the stationary shaft for producing bending moments biasing the central portion of the stationary shaft in a direction generally toward the fluid pick-up roller;

(b) at least one bearing engaging the stationary shaft adjacent the interior of the metering roller, and engaging the rotatable inwardly facing surface of the metering roller; and (c) adjustment means for selectively adjusting the bending moments produced by the fulcrum and force application means;

wherein the fulcrum and force application means includes a fulcrum directly supporting the stationary shaft near each end, and means for applying a force directly to the shaft at a point inwardly along the shaft from each fulcrum, and each fulcrum comprises first and second screws oriented at an acute angle with ends adjacent to receive and support the stationary shaft therebetween, each screw being adjustable to change the support point for the shaft in the direction of the screw axis.

2. The control system of claim 1, wherein a plurality of annular bearings are axially spaced along the stationary shaft to engage the metering roller for distributing along the metering roller forces resulting from the bending moments produced in the stationary shaft.

3. The control system of claim 2, wherein the plurality of bearings are releasably secured in their position on the shaft so that their axial locations may be adjusted.

4. The control system of claim 2, wherein the plurality of bearings are spaced inwardly from the ends of the metering roller, and are arranged symmetrically with respect to the mid-point between the ends of the metering roller.

5. The control system of claim 1, wherein each fulcrum is carried by one of a pair of side frames through which the stationary shaft extends, and each force applying means comprises:

a mounting block positioned on the interior face of the side frame, and pivotable about a first pivot point;

a forcing cam mounted on the block and rotatable with respect thereto about a second pivot point spaced from the first pivot point, the forcing cam having a constant radius outer surface about a major portion of its periphery, and a cutaway surface over a minor portion of the periphery, whereby when the cam is rotated so that its cutaway surface is adjacent the stationary shaft it does not engage the stationary shaft and when it is rotated so that its curved surface is adjacent the stationary shaft, it does engage the stationary shaft; and the adjustment means associated with each force applying means permits adjustment of the pivotal orientation of the mounting block so as to move the second pivot point toward or away from the stationary shaft.

6. In a metering roller apparatus having a stationary shaft with first and second ends, and a rotary metering roller surrounding the stationary shaft for a portion of the distance between the first and second ends, said metering roller engaging a liquid pick-up roller to meter liquid through the nip between the two rollers, a system for controlling the metering of liquid comprising:

a first fulcrum directly receiving the stationary shaft adjacent its first end, and supporting the stationary shaft in at least a first direction perpendicular to the shaft;

a second fulcrum directly receiving the stationary shaft adjacent its second end, and supporting the stationary shaft in at least said first direction;

first force applying means directly engaging the stationary shaft at a point spaced inwardly along the shaft from the first fulcrum and outwardly from the end of the metering roller, and exerting an adjustable force on the stationary shaft in a second direction substantially opposite to said first direction;

second force applying means directly engaging the stationary shaft at a point spaced inwardly along the shaft from the second fulcrum and outwardly from the end of the metering roller, and exerting an adjustable force on the stationary shaft in the second direction;

means for adjusting the force exerted by the first and second force applying means on the stationary shaft; and at least one annular bearing engaging the stationary shaft and the rotatable inwardly facing surface of the metering roller spaced from the ends of the metering roller.

7. The control system of claim 6, wherein a plurality of annular bearings are axially spaced along the stationary shaft to engage the metering roller for distributing along the length of the metering roller the force resulting from the bending moments produced in the stationary shaft.

8. The control system of claim 7, wherein the plurality of bearings are releasably secured in their position on the shaft so that their axial locations may be adjusted.

9. The control system of claim 7, wherein the plurality of bearings are spaced inwardly from the ends of the metering roller, and are arranged symmetrically with respect to the mid-point between the ends of the metering roller.

10. The control system of claim 9, wherein each fulcrum is carried by one of a pair of side frames through which the stationary shaft extends, and each force applying means comprises:

a mounting block positioned on the interior face of the side frame, and pivotable about a first pivot point;

a forcing cam mounted on the block and rotatable with respect thereto about a second pivot point spaced from the first pivot point, the forcing cam having a constant radius outer surface about the major portion of its periphery, and a cutaway surface over a minor portion of the periphery, whereby when the cam is rotated so that its cutaway surface is adjacent the stationary shaft it does not engage the shaft and when it is rotated so that its curved surface is adjacent the shaft, it does engage the shaft; and the adjustment means associated with each force applying means adjusts the pivotal orientation of the mounting block so as to move the second pivot point toward or away from the stationary shaft.

11. The control system of claim 9, wherein each fulcrum is carried by one of a pair of side frames through which the stationary shaft extends, and each force applying means comprises:

a mounting block positioned on the interior face of the side frame, and pivotable about a first pivot point;

a forcing cam mounted on the block and rotatable with respect thereto about a second pivot point spaced from the first pivot point, the forcing cam having a constant radius outer surface about the major portion of its periphery, and a cutaway surface over a minor portion of the periphery, whereby when the cam is rotated so that its cutaway surface is adjacent the stationary shaft it does not engage the shaft and when it is rotated so that its curved surface is adjacent the shaft, it does engage the shaft; and the adjustment means associated with each force applying means adjusts the pivotal orientation of the mounting block so as to move the second pivot point toward or away from the stationary shaft.

12. The control system of claim 6, wherein the apparatus includes a liquid-receiving roller engaging the metering roller, and wherein each fulcrum comprises first and second screws oriented at an acute angle with ends adjacent to receive and support the stationary shaft therebetween, each screw being adjustable to change the support point for the shaft in the direction of the screw axis.

13. A dampener for an offset press comprising:

(a) a water pan;

(b) a liquid pick-up roller positioned partially in the pan;

(c) a metering roller rotatably engaged with the liquid pick-up roller;

(d) a stationary shaft extending along the axis of the metering roller, having first and second ends extending beyond the metering roller;

(e) a fulcrum adjacent each of said first and second ends of the stationary shaft, directly supporting the shaft in at least a first direction perpendicular to the shaft;

(f) force applying means directly engaging the stationary shaft at points spaced inwardly along the shaft from each fulcrum and outwardly from the end of the metering roller, and applying a force on the shaft in a second direction generally opposite to the first direction;

(g) annular bearing means mounted on the stationary shaft and engaging the inner rotating surface of the metering roller;

(h) adjustment means for selectively varying the force exerted by the force applying means on the stationary shaft; and (i) form roller means for receiving liquid from the metering roller and transferring it to the press.

14. The dampener of claim 13, wherein the baring means comprise a plurality of spaced annular bearings releasably secured at selected locations along the stationary shaft, having outer bearing faces engaging the inner surface of the metering roller spaced inwardly from the ends of the metering roller.

15. The dampener of claim 14, wherein the plurality of bearings are releasably secured in their position on the shaft so that their axial locations may be adjusted.

16. The control system of claim 14, wherein the plurality of bearings are spaced inwardly from the ends of the metering roller, and are arranged symmetrically with respect to the midpoint between the ends of the metering roller.

17. The control system of claim 13, wherein the apparatus includes a liquid-receiving roller engaging the metering roller, and wherein each fulcrum comprises first and second screws oriented at an acute angle with ends adjacent to receive and support the stationary shaft therebetween, each screw being adjustable to change the support point for the shaft in the direction of the screw axis.

* * * * *

UNITED STATES PATENT AND TRADEMARK OFFICE

CERTIFICATE OF CORRECTION

PATENT NO. : 5,022,322

DATED : JUNE 11, 1991

INVENTOR(S) : JAMES J. KELLER

It is certified that error appears in the above-identified patent and that said Letters Patent is hereby corrected as shown below:

Column 5, line 66, following "36", insert -- through --.

Column 6, line 1, delete "Adjust" and insert --Adjustments--.

Column 10, line 1, delete "baring" and insert -- bearing --.

Signed and Sealed this

First Day of December, 1992

*Attest:*

DOUGLAS B. COMER

*Attesting Officer*

*Acting Commissioner of Patents and Trademarks*